United States Patent [19]

Takahashi

[11] 4,171,688

[45] Oct. 23, 1979

[54] INTAKE CONTROL APPARATUS

[75] Inventor: Akira Takahashi, Kyoto, Japan

[73] Assignee: Mitsubishi Jidosha Kogyo Kabushiki Kaisha, Tokyo, Japan

[21] Appl. No.: 804,462

[22] Filed: Jun. 7, 1977

[30] Foreign Application Priority Data

Mar. 4, 1977 [JP] Japan ..... 52-24022

[51] Int. Cl.[2] ..... F02M 25/06

[52] U.S. Cl. ..... 123/119 A; 123/124 R

[58] Field of Search ..... 123/119 A, 124 R, 124 B

[56] References Cited

U.S. PATENT DOCUMENTS

| | | | |
|---|---|---|---|
| 1,766,673 | 6/1930 | Moore | 123/119 A |
| 3,802,402 | 4/1974 | Swatman | 123/119 A |
| 3,805,752 | 4/1974 | Cataldo | 123/119 A X |
| 3,955,364 | 5/1976 | Lewis | 123/124 R X |
| 4,005,692 | 2/1977 | Nohira et al. | 123/119 A |
| 4,047,509 | 9/1977 | Arnaud | 123/124 R X |
| 4,048,968 | 9/1977 | Aoyama | 123/119 A |
| 4,088,101 | 5/1978 | Wakita | 123/119 A |

*Primary Examiner*—Carlton R. Croyle
*Assistant Examiner*—Michael Koczo, Jr.
*Attorney, Agent, or Firm*—Wenderoth, Lind & Ponack

[57] ABSTRACT

An improved intake control apparatus for internal combustion engines which can reduce the amount of nitrogen oxide in the exhaust gas by additionally feeding a part of the exhaust gas as well as air or lean mixture gas into an intake system in correlation with the operating condition of the engine. The improved apparatus is characterized by the provision of an exhaust gas recirculation path communicating the exhaust path with the intake path for recirculating a part of the exhaust gas, at least two exhaust gas recirculation rate control valves in said exhaust gas recirculation path in series with each other, a diluting intake path disposed in the exhaust gas recirculation path between two particular control valves among the plurality of control valves for taking in atmospheric air or lean mixture gas, and an intake control valve in the diluting intake path.

12 Claims, 10 Drawing Figures

Figure 1:
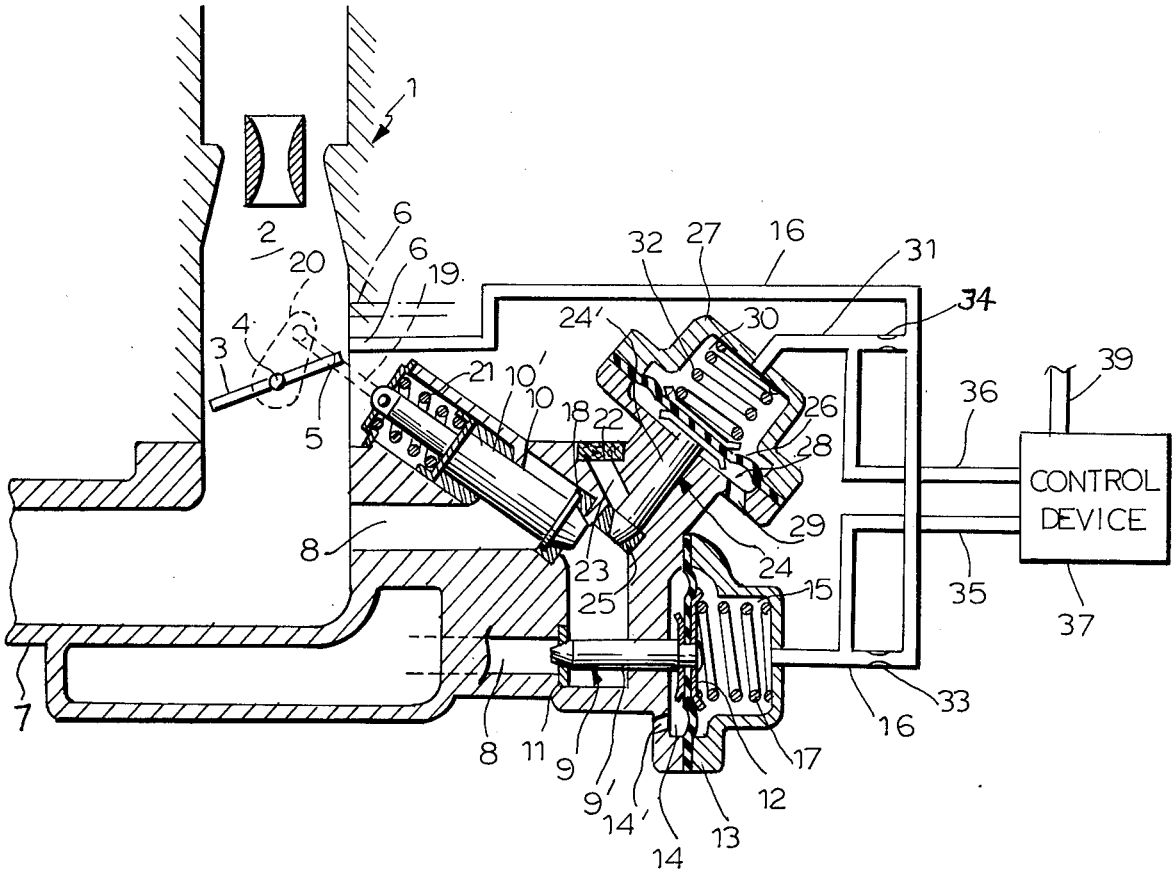

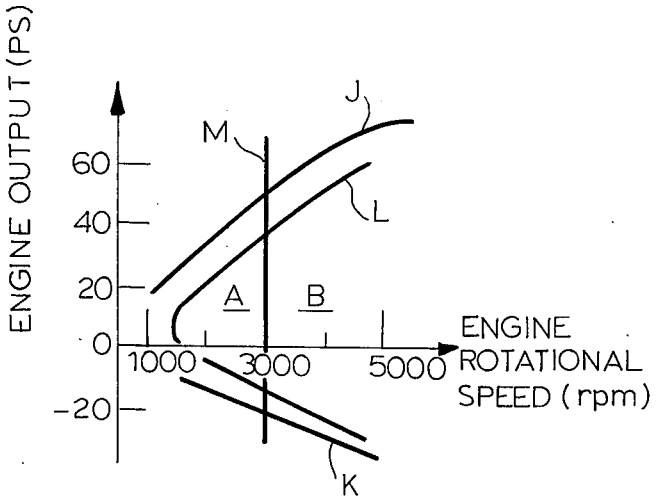
FIG.3
FIG.5
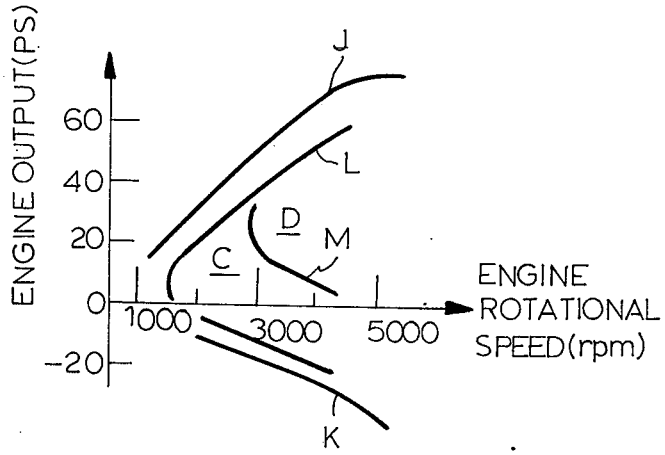
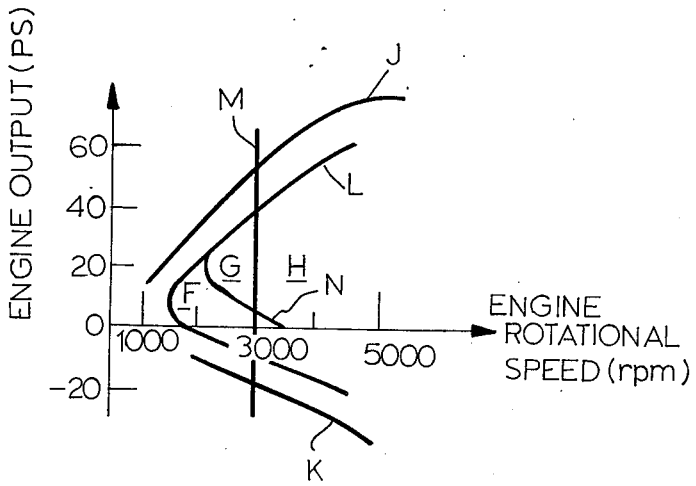
FIG.9

INTAKE CONTROL APPARATUS

The present invention relates to an intake control apparatus for feeding a part of the exhaust gas and air into an intake system of an internal combustion engine in correlation with the operating condition of the engine.

In general, an exhaust gas recirculating device for an internal combustion engine is provided for the purpose of reducing harmful nitrogen oxide contained in the exhaust gas, and this device seeks to reduce the generation of nitrogen oxide by recirculating a part of the exhaust gas through the intake system of the internal combustion engine into the cylinders and thereby lower the combustion temperature.

However, when the exhaust gas is recirculated, generally the combustion efficiency of the fuel within the cylinders is poor, and if a large amount of exhaust gas is recirculated, then not only are output power and fuel consumption greatly deteriorated, but also the drivability of a vehicle driven by the engine is degraded, and unfavorable events such as engine stall may result.

Therefore, heretofore the exhaust gas recirculation rate has been controlled in a complex manner in correlation with various operating conditions taking into consideration the amount of generation of nitrogen oxide, output power and fuel consumption.

In this connection, as a method for reducing the amount of generation of nitrogen oxide in the combustion process, besides the above-mentioned exhaust gas recirculation system, a lean mixture combustion system has been proposed and according to the latter system, a mixture of gas and air having an air-to-fuel ratio somewhat leaner than the stoichiometric ratio such as, for instance, about 16–23 can be favorably burnt, and as the lean mixture is generally poor with respect to ignitability and bad with respect to combustibility, various systems for overcoming these disadvantages have been employed.

For instance, an auxiliary combustion chamber system, a stratified combustion system, a vortex generating system or the like have been proposed, and according to these systems, the ignitability is enhanced by introducing a rich mixture of air and fuel to the neighborhood of an ignition plug or strongly scavenging the same neighborhood, the flame propagation speed is enhanced by generation of strong vortexes or the like, and thereby the combustibility is improved.

The above-mentioned two systems for reducing generation of nitrogen oxide respectively have both advantages and disadvantages; that is, the exhaust gas recirculation system has a high rate of reduction of nitrogen oxide but is inferior in producing output power and in fuel consumption as described above, whereas in the lean mixture combustion system, although the air-to-fuel ratio control in the carburetor or the like is difficult and also the rate of reduction of nitrogen oxide is low, there are the advantages that the fuel consumption is improved and the drivability of the vehicle having the engine therein is better than in the exhaust gas recirculation system.

A principal object of the present invention is to provide an intake control apparatus in which the generation of nitrogen oxide can be reduced by additionally feeding a part of the exhaust gas as well as air or a lean mixture of air and fuel into an intake system in correlation with the operating condition of the engine.

Another object of the present invention is to provide an intake control apparatus which is particularly useful for automobile engines, which can minimize the generation of nitrogen oxide while not unduly lowering the output power and keeping degradation of fuel consumption and drivability to a minimum.

Still another object of the present invention is to provide an intake control apparatus that is simple in structure, compact and less expensive than prior art devices, in which feed rate control for air or a lean air-fuel mixture to be additionally fed for diluting the mixture of gas taken into the engine is effected in common by a particular control valve in an exhaust gas recirculation device.

Another object of the present invention is to provide an intake control apparatus particularly useful for automobile engines, in which switching between exhaust gas recirculation and feeding of diluting air or a lean air-fuel mixture can be effected smoothly without occurrence of deviations of engine operation over the course of time such as overlapping of the two controls or occurance of a period between operation of the respective controls, so that drivability of the automobile driven by the engine the above switching is excellent and also the amount of nitrogen oxide which is exhausted can be reduced.

Yet another object of the present invention is to provide an intake control apparatus particularly useful for automobile engines, in which in the engine operating range often used during running in a street, for instance, during low speed or light load operations, exhaust gas recirculation is effected to greater reduce the amount of nitrogen oxide generated, whereas during high speed or heavy load operations, the exhaust gas recirculation is reduced and simultaneously air or a lean air-fuel mixture is introduced into the intake system to dilute the gas, and thereby drivability and fuel consumption can be improved and generation of knocking can be suppressed.

The above-described objects can be achieved by an intake control apparatus comprising an exhaust gas recirculation path connecting an exhaust path to an intake path for recirculating a part of exhaust gas, at least two exhaust gas recirculation rate control valves in said exhaust gas recirculation path in series with each other, a diluting intake path disposed in said exhaust gas recirculation path between two particular control valves among said plurality of control valves for taking in atmospheric air or a lean air-fuel mixture, and an intake control valve in said diluting intake path.

Figure 2:
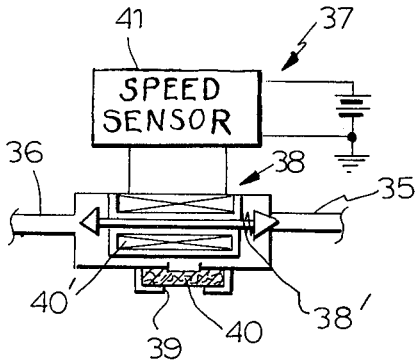
Figure 4:
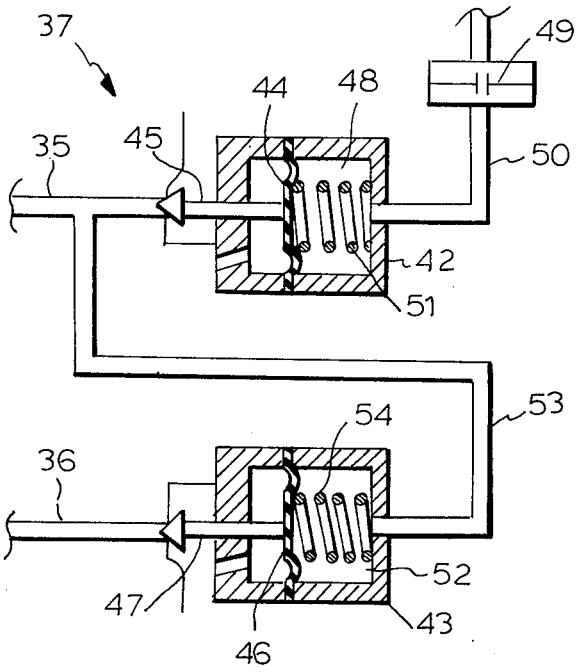
Figure 6:
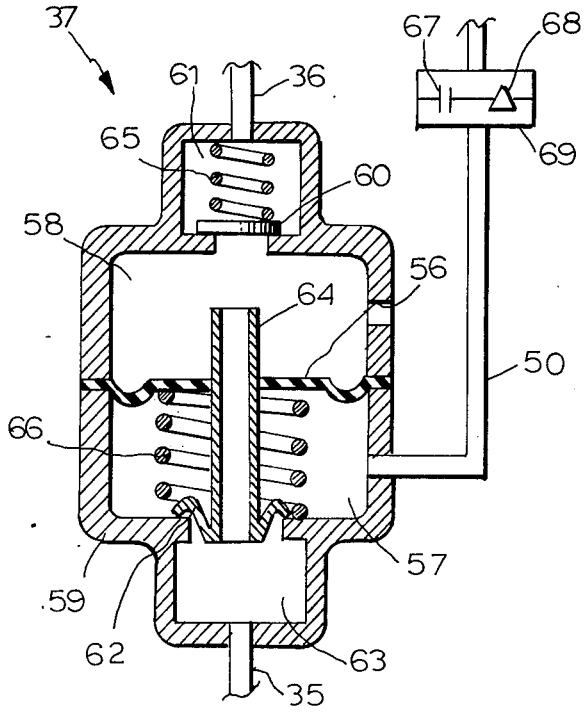
Figure 7:
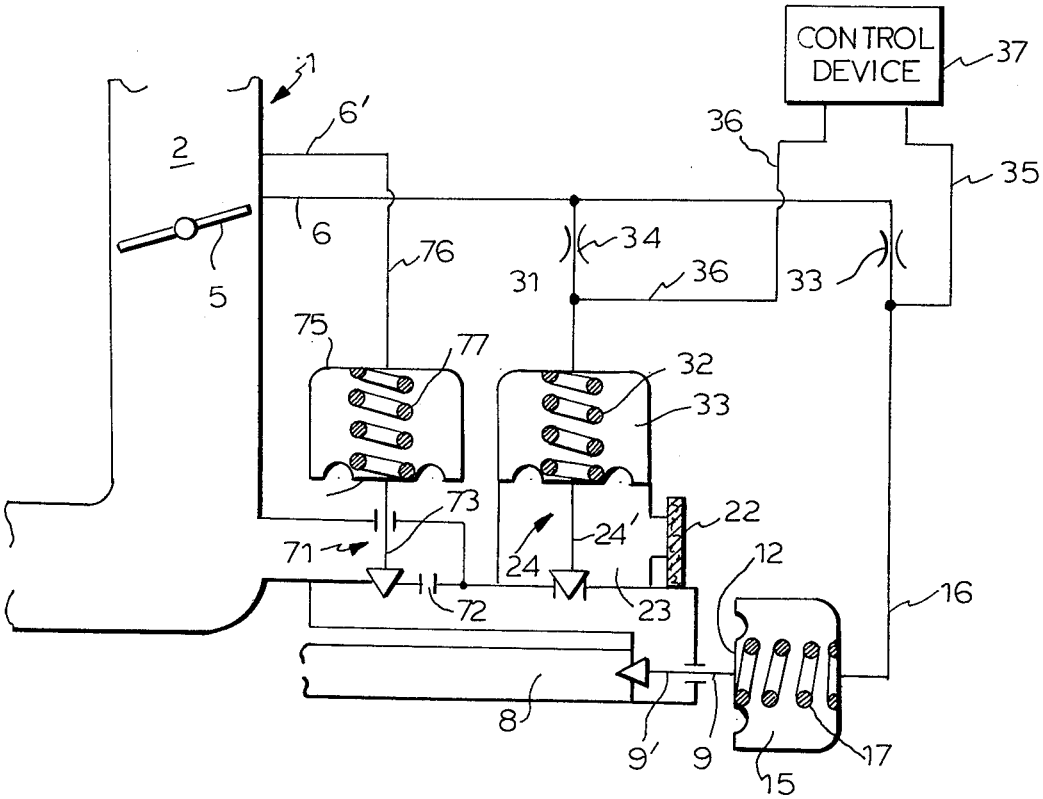
Figure 8:
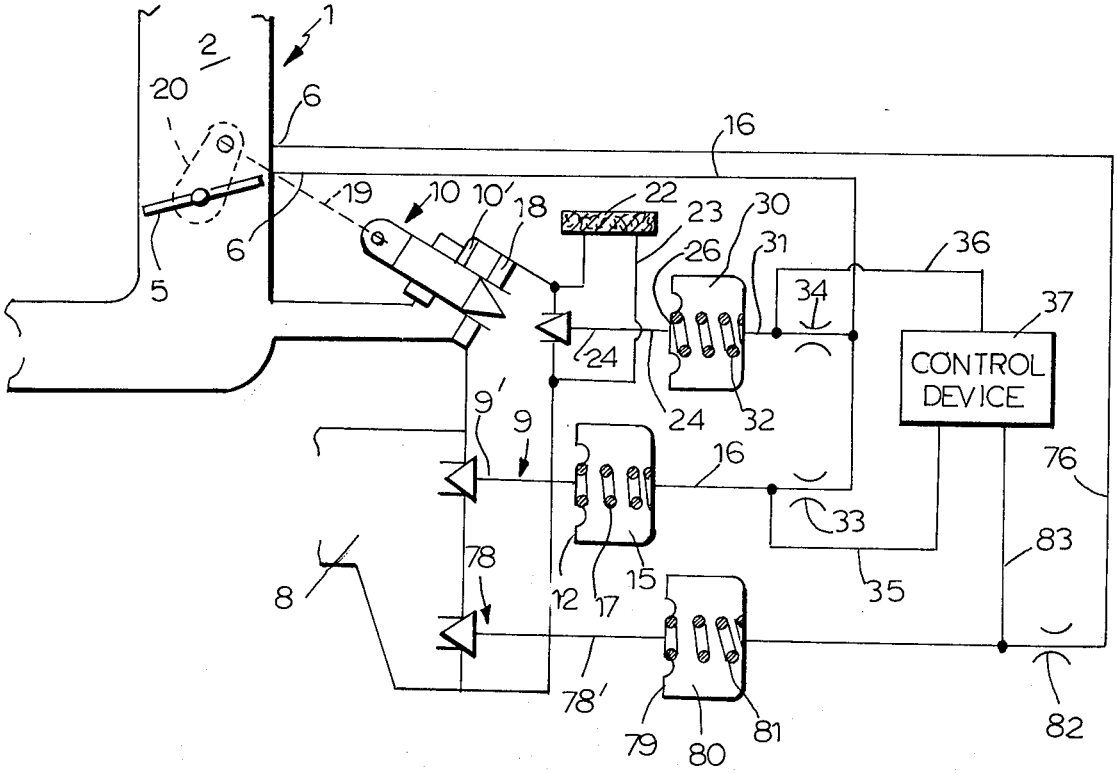
Figure 10:
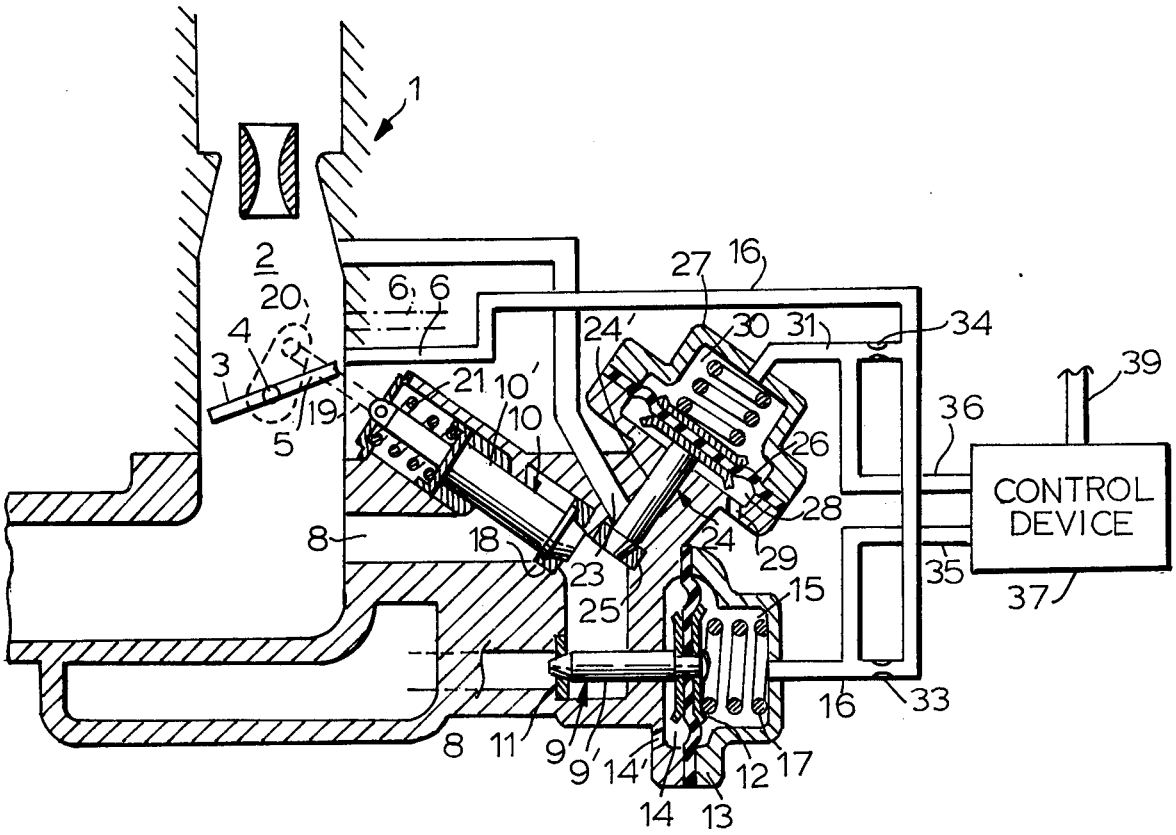

These and other features and objects of the present invention will become more apparent by reference to the following description taken in conjunction with the accompanying drawings, in which:

FIG. 1 is a cross-section of a first preferred embodiment of the intake control apparatus of the present invention, FIG. 2 is a schematic view showing a control device to be used in the first preferred embodiment, FIG. 3 is an engine output diagram for explaining the operation of the first preferred embodiment, FIG. 4 is a cross-section of a modification of the control device used in the first preferred embodiment, FIG. 5 is an engine output diagram for explaining the operation of the modification shown in FIG. 4, FIG. 6 is a cross-section of another modification of the control device to be used in the first preferred embodiment, FIG. 7 is a schematic view of a second preferred embodiment of the intake control apparatus of the present invention, FIG. 8 is a schematic view of a third preferred embodiment of the intake control apparatus of the present invention, FIG. 9 is an engine output diagram for explaining the operation of the third preferred embodiment, and FIG. 10 is a cross-section similar to FIG. 1 showing a modified embodiment.

Now the present invention will be described in more detail in connection to the preferred embodiments illustrated in FIGS. 1 through 9 of the drawings. It is to be noted that in the respective embodiments, identical or equivalent members or parts are designated by the same reference numerals.

In the first preferred embodiment of the present invention illustrated in FIG. 1, midway in an intake 2 of a carburetor 1 is pivotably mounted a throttle valve 3 so to be rotatable about a throttle shaft 4, said throttle valve 3 being adapted to be opened and closed by being linked to a control device such as an acceleration pedal of a vehicle, not shown, and in the proximity of the upstream side edge 5 of the throttle valve 3, is drilled a port 6 in an intake tube wall somewhat upstream of a fully closed position of the throttle valve 3. This port 6 will be on the downstream side of the edge 5 of the throttle valve 3 when the throttle valve 3 is opened to a predetermined angle of opening such as, for example, about 15°–20° or more.

An intake manifold 7 connected to the above-described carburetor 1 for distributing and feeding a mixture of gas to respective cylinders of a multi-cylinder engine, not shown, has opening thereinto an exhaust gas recirculation passage 8 that is connected with an exhaust path, not shown, and midway of the recirculating passage 8 are two exhaust gas recirculation rate control valves 9 and 10 in series with each other for opening and closing the recirculation passage 8.

The control valve 9 located upstream in the exhaust gas recirculation passage 8 has a valve body 9′ adapted to close the path 8 when the tapered end abuts a valve seat 11 provided in the passage 8 and has the other end fixedly secured rear end to a center portion of a diaphragm 12, which divides an interior of a housing 13 into two chambers, one chamber 14 being open to the atmosphere through a hole 14′ in the housing 13, and the other chamber 15 being connected with the port 6 through a negative pressure passage 16. Within the chamber 15 is contained a spring 17 for urging the diaphragm 12 in the direction for closing the control valve 9.

The control valve 10 located on the downstream side of the control valve 9 has one end of a link 19 coupled to a rear end portion of a valve body 10′ which is adapted to close the valve 10 by the tip end abutting a valve seat 18 provided in the exhaust gas recirculation passage 8, and the other end of the same link 19 is coupled to the free end of a lever fixedly secured to the throttle shaft 4. The valve body 10′ is urged by a spring 21 in the direction for closing the valve 10. Between the control valves 9 and 10 in the exhaust gas recirculation passage 8 is a diluting intake path 23 opening into the passage 8 for taking in atmospheric air through an air filter 22, and in the same passage 23 is an intake control valve 24.

The intake control valve 24 has a valve body 24′ adapted to close the valve by the tip end abutting against a valve seat 25 provided in the diluting intake passage 23, and is fixedly secured at its rear end to a center portion of a diaphragm 26, which divides the interior of a housing 27 into two chambers, one chamber 28 being open to the atmosphere through a hole 29, and the other chamber 30 being communicated with the vacuum passage 16 through a vacuum passage 31. A spring 32 contained within the chamber 30 urges the diaphragm 26 in the direction for closing the control valve 24.

In addition, in the vacuum passages 16 and 31 have therein orifices 33 and 34, respectively, and to the vacuum path 16 between the orifice 33 and the chamber 15 is coupled another passage 35, and to the vacuum passage 31 between the orifice 34 and the chamber 30 is coupled still another passage 36. These respective passages 35 and 36 are connected to a control device 37, and the respective passages 35 and 36 are selectively opened or closed by means of a solenoid valve 38, in such manner that when one passage is closed the other passage is opened, and vice versa, and the control device 37 is open to the atmosphere through an aperture 39 in which an air filter 40 is provided, as shown in FIG. 2.

In the illustrated embodiment, the control device 37 is constructed in such manner that when the engine speed is lower than a predetermined rotational speed such as, for example, 3000 rpm as sensed by an engine speed sensor 41, the passage 35 is closed by valve member 38*a* being urged to the right by spring 38′ and the passage 36 is opened, while when the rotational speed is higher than the predetermined rotational speed, a solenoid 40′ is energized to move valve number 38*a* to the left to open the passage 35 and close the path 36.

Now the operation of the apparatus according to the above-described first preferred embodiment will be described with reference to FIG. 3. FIG. 3 is an engine output diagram in which the engine output (PS) is along the ordinate and the engine speed (rpm) is along the abscissa, the solid line curve J representing full-open output when the throttle valve 3 is fully opened, the solid line curve K representing an output at the idling angle of opening (3 degrees–6 degrees) of the throttle valve, the solid line curve L representing the negative equi-pressure output when the vacuum generated in the port 6 (hereinafter called "EGR boost")is equal to 100 mm Hg, and the solid straight line M representing the constant speed output at a constant engine rotational speed of 3000 rpm.

When the engine is driven and the throttle valve 3 is opened to an angle greater than the idling angle of opening, an EGR boost is generated in the port 6, and this vacuum is communicated through the vacuum passage 16 to the chamber 15 and also through the vacuum passages 16 and 31 to the chamber 30.

If the engine speed is lower than 3000 rpm, the engine speed sensor 41 does not generate an output, so that the passage 35 is closed by the solenoid valve 38, while the passage 36 is open to the atmosphere, and consequently, atmospheric air is fed to the chamber 30 through the passage 36 and the vacuum passage 31. In this case, the feed of the atmospheric air to the vacuum passage 31 does not significantly affect the vacuum established in the chamber 15 due to the prescence of the orifice 34, so that a vacuum substantially equal to the EGR boost generated in the proximity of the port 6 is established in the chamber 15.

Accordingly, under such a condition, if the engine output and the rotational speed are varied and the EGR boost exceeds a predetermined value such as, for example, 100 mm Hg, then in the control valve 9 which has been closed by the force of the spring 17, the diaphragm 12 is sucked into the chamber 15 by the above-described EGR boost, and thus the valve body 9' is displaced against the resilient urging force of the spring 17 in the direction for opening the control valve 9, the amount of opening being correlated to the magnitude of the EGR boost.

In FIG. 3, the solid line curve L represents the output for a negative equi-pressure of the EGR boost of 100 mm Hg at the beginning of the opening of the control valve 9, and in the region A on the right side of the solid line curve L and for an engine speed lower than 3000 rpm, the control valve 9 is opened and the degree of opening is determined in correlation with the magnitude of the EGR boost.

On the other hand, when the engine rotational speed is higher than 3000 rpm, the solenoid valve 38 is operated in response to a command from the engine speed sensor 41, so that the path 35 is opened to the atmosphere while the passage 36 is closed, and consequently, the atmospheric air is fed to the chamber 15 through the vacuum passage 16.

In this case, the feed of the atmospheric air to the vacuum path 16 does not significantly affect the vacuum established in the chamber 30 due to the presence of the orifice 33, so that a vacuum substantially equal to the EGR boost generated in the proximity of the port 6 is established in the chamber 30.

Assuming that the control valve 24 is preset so as to be opened against the resilient urging force of the spring 32 when the vacuum exerted upon the diaphragm 26 exceeds 100 mm Hg similarly to the above-described control valve 9, the control valve 24 would be opened in the region B on the right side of the solid line curve L and for an engine speed higher than 3000 rpm in FIG. 3, resulting in feeding of air from the diluting intake path 23 into the exhaust gas recirculation path 8. On the other hand, the control valve 10 is opened in correlation to the angle of opening of the throttle valve 3 since it is mechanically coupled to the throttle valve 3 by the link 19, and the degree of opening of the control valve 10 is substantially proportional to the angle of opening of the throttle valve 3.

Since the exhaust gas is returned to the intake manifold 7 through the exhaust gas recirculation passage 8 by the pressure difference between the exhaust gas pressure and the vacuum in the intake manifold, where the flow path resistance in the path 8 is constant, the smaller the degree of opening of the throttle valve 3 and the higher the intake manifold vacuum under a given operating condition, the more the exhaust gas recirculation rate is increased, but due to the above described operation, the unfavorable results, namely that the exhaust gas recirculation rate becomes too high in the light load region, while the exhaust gas recirculation rate becomes too low in the medium and heavy load regions, can be eliminated by making the opening characteristics of the control valve 10 such that the degree of choking is reduced in inverse proportion to the engine output.

In the illustrated embodiment, among the operating regions often used when running a vehicle with the engine therein on the street, in the region A where the combustibility is excellent but the amount of generation of nitrogen oxide is apt to be increased, the control valves 9 and 10 are opened but the intake control valve 24 is closed, so that a part of the exhaust gas is sucked into the intake manifold 7 through the exhaust gas recirculation passage 8 and is mixed with the mixture of fuel and air from the carburetor 1.

In this connection, the exhaust gas recirculation rate is controlled in correlation with the degrees of opening of the respective control valves 9 and 10, and the control is effected in such manner that an appropriate amount of exhaust gas for suppressing generation of nitrogen oxide is recirculated in accordance with the rate of generation of nitrogen oxide in an engine operating at a similar driving condition where the exhaust gas recirculation is not effected.

In addition, among the operating regions of the engine often used when running in the suburbs, in the region B where the rate of generation nitrogen oxide is apt to be increased, the control valve 9 is closed but the control valve 10 and the intake control valve 24 are opened, so that atmospheric air cleaned by the air filter 22 is sucked into the intake manifold 7 through the diluting intake passage 23 and the exhaust gas recirculation passage 8 to dilute the mixture of air and fuel from the carburetor 1. The rate of intake of the atmospheric air is controlled in correlation with the degrees of opening of both the control valve 10 and the intake control valve 24, so that in the operating region where a large amount of nitrogen oxide would be generated if atmospheric air was not added, a large amount of atmospheric air is sucked into dilute the air-fuel mixture, and thereby the generation of nitrogen oxide can be effectively suppressed.

In the above-described preferred embodiment, when the operating condition shifts from the region A to the region B or from the region B to the region A, the control mode can be switched without interruption from the exhaust gas recirculation mode to the atmospheric air suction mode or from the atmospheric air suction mode to the exhaust gas recirculation mode, so that the engine output will never vary temporarily to any great degree during the course of the above-described switching and the drivability of the vehicle is excellent.

As will be apparent from the above description, according to the above-described preferred embodiment of the present invention, the effects and advantages achieved are that: in the regions in the proximities of the full-open output and idling, neither the exhaust gas recirculation or the air intake through the diluting intake passage 23 are effected, whereby disadvantages such as lowering of output power, degradation of fuel consumption, generation of engine vibration, etc., can be prevented; in the low speed and medium load region, nitrogen oxide can be effectively reduced by the exhaust gas recirculation with the recirculation rate being controlled by the control valves 9 and 10; and in the high speed region, appropriate air intake is effected to dilute the air-fuel mixture by the control valve 10 and the intake control valve 24, whereby the generation of nitrogen oxide can be reduced while the fuel consumption can be improved, and further generation of knocking caused by too early ignition can be suppressed.

One modification of the control device 37 in the above-described first preferred embodiment is described below with reference to FIGS. 4 and 5.

The control device 37 illustrated in FIG. 4 comprises two diaphragm devices 42 and 43, an ON-OFF valve 45 operatively driven by a diaphragm 44 in the diaphragm device 42 effects the control for opening to the atmosphere of the passage 35, while an ON-OFF valve 47 operatively driven by a diaphragm 46 in the diaphragm device 43 effects the control for opening to the atmosphere of the passage 36. To a vacuum chamber 48 on one side of the above-described diaphragm 44 is introduced the intake vacuum generated at a predetermined location within the intake passage 2 as illustrated in the above-described first preferred embodiment, through a vacuum passage 50 having an orifice 49 therein, so as to suck the diaphragm 44 into chamber 48 against the resilient urging force of a spring 51 in the vacuum chamber 48 in the direction for opening the ON-OFF valve 45. On the other hand, to a vacuum chamber 52 on one side of the diaphragm 46 is connected the passage 35 through a vacuum passage 53, so that the same vacuum as that established in the vacuum chamber 15 in the above-described first embodiment is generated in the vacuum chamber 52 to suck the diaphragm 46 into chamber 52 against the resilient urging force of a spring 54 in the vacuum chamber 52 in the direction for opening the On-OFF valve 47.

In the above-described modification, where the vacuum passage 50 is connected to a port 6' drilled in the intake passage wall somewhat upstream of the port 6 in the above-described first preferred embodiment as shown in phantom lines in FIG. 1, then control is effected as illustrated in the output diagram in FIG. 5.

It is to be noted that in the output diagrams shown in FIG. 5 and also in FIG. 9 as described later, valves and curves identical or equivalent to those shown in FIG. 3 are designated by the same reference characters.

In FIG. 5, the solid line curve M is the output for a negative equi-pressure when a predetermined negative pressure acts upon the vacuum chamber 48 to open the ON-OFF valve 45, and where the vacuum at the port 6' that is established in the vacuum chamber 48 is lower than a predetermined pressure, the ON-OFF valve 45 is closed by the resilient urging force of the spring 51, so that the vacuum generated in the port 6 is introduced not only to the vacuum chamber 15 through the vacuum passage 16 but also to the vacuum chamber 52 through the passages 35 and 53, and the ON-OFF valve 47 is opened by this vacuum, resulting in opening of the passage 36 to the atmosphere.

On the other hand, passage where the vacuum established in the vacuum chamber 48 is higher than a predetermined pressure, than the ON-OFF valve 45 is opened, so that the passage 35 is opened to the atmosphere and the vacuum chamber 52 has the atmospheric pressure therein, and thus the ON-OFF valve 47 is closed by the resilient urging force of the spring 46.

Accordingly, in FIG. 5, in the region C on the right side of the solid line curve L and on the left side of the solid line curve M the exhaust gas recirculation is effected, in the region D on the right side of the solid line curve M the suction of diluting air is effected, and in the other operating regions both the exhaust gas recirculation and the air suction are interrupted.

FIG. 6 shows another modification of the control device 37 in the above-described first preferred embodiment, and this control device can achieve a control equivalent to the control device 37 shown in FIG. 4 with a more compact construction. In this embodiment the passages 35 and 36 and the vacuum passage 50 are connected to a housing 59 containing a diaphragm 56 therein and having the interior divided into two chambers 57 and 58, the passage 36 being connected with a chamber 61 which is adapted to be connected through an ON-OFF valve 60 to the chamber 58 opened to the atmosphere. At the central portion of the diaphragm 56 is mounted a pipe 64 for connecting a chamber 63 that is isolated from the chamber 57 by means of bellows 62 to the chamber 58, with the axis of the pipe being aligned in the direction of displacement of the diaphragm 56, and the open end of the pipe 64 toward the chamber 58 is adapted to strike against the aforementioned ON-OFF valve 60 when the pipe 64 is displaced upwardly as viewed in FIG. 6, and open the ON-OFF valve 60 against a resilient urging force of a spring 65, which normally urges the ON-OFF valve 60 downwardly, when the pipe 64 is further displaces upwardly to place the chambers 58 and 61 in communication with each other. It is to be noted that when the pipe 64 strikes the ON-OFF valve 60, the communication between the chambers 58 and 63 is interrupted.

In addition, the passage 35 is connected with the chamber 63, the vacuum path 50 is connected with the chamber 57, in which a spring 66 adapted to urge the diaphragm 56 upwards is contained, and in the vacuum passage 50 connected to the above-mentioned port 6' is a flow rate limiter device 69 consisting of an orifice 67 and a check valve 68 disposed in parallel to each other. This is in place of the orifice 49 of the FIG. 4 embodiment.

The above-described control device 37 shown in FIG. 6 has substantially the same control characteristics as those shown in FIG. 5 for the control device 37 illustrated in FIG. 4.

The second preferred embodiment schematically illustrated in FIG. 7 has a construction in which, in lieu of the control valve 10 in the above-described first embodiment which is mechanically correlated with the movement of the throttle valve 3 via the link 19, there is provided a control valve 71 which is pneumatically controlled in response to the magnitude of the vacuum generated in the port 6' in the intake passage wall somewhat upstream of the port 6 to effect opening and closing of the exhaust gas recirculation passage 8, and also there is provided a by-pass passage 72 parallel to the path opened by the control valve 71. The control valve 71 has a valve body 73 connected to a central portion of a diaphragm 74, a vacuum chamber 75 for actuating the diaphragm 74 and connected with the port 6' through a vacuum passage 76, and in the vacuum chamber 75 is contained a spring 77 for urging the diaphragm 74 in the direction for closing the valve body 73.

The control valve 71 in the above-described second preferred embodiment serves to prevent an excessive flow of the recirculated exhaust gas or intake air at a light load condition where the angle of opening of the throttle is small, and to effect recirculation of a large amount of exhaust gas or intake of a large amount of air at a heavy load condition where the angle of opening of the throttle is large, similarly to the control valve 10 in the above-described first preferred embodiment. At a light load condition, the vacuum generated in the port 6' is small, and accordingly, the vacuum generated in the vacuum chamber 75 is also small, so that the valve body 73 is closed by the resilient urging force of the spring 71. Under such a condition, the exhaust gas recirculation or the air intake is effected only through the by-pass passage 72, and thus the flow rate is small. On the other hand, at a heavy load condition, the vacuum generated in the port 6' is large, so that the diaphragm 74 is sucked into chamber 75 against the resilient urging force of the spring 77 by the high vacuum generated in the vacuum chamber 75, and thereby the valve body 73 is opened. Under such a condition, the exhaust gas or the intake air can flow through the valve 71 as well as the by-pass path passage 72, whereby the flow rate is increased. It is to be noted that the operations of the exhaust gas recirculation rate control valve 9 and the intake control valve 24 are exactly the same as those of the above-described first preferred embodiment.

The third preferred embodiment of the present invention illustrated in FIGS. 8 and 9 has a construction in which there is added to the above-described first preferred embodiment an additional control valve 78 which is parallel to the control valve 9 in the exhaust gas recirculation passage 8. This control valve 78 has a valve body 78' connected to a central portion of a diaphragm 79, a vacuum chamber 80 for actuating the diaphragm 79 is connected through a vacuum path 76 to the port 6' in the intake passage wall somewhat upstream of the port 6, and in the vacuum chamber 80 is contained a spring 81 for urging the diaphragm 79 in the direction for closing the valve body 78'.

In addition, in the vacuum path 76 is an orifice 82, the vacuum passage between the orifice 82 and the vacuum chamber 80 is connected via a branch passage 83 to the control device 37, and the branch passage 83 is either opened to the atmosphere or closed off, similarly to the passage 35 in the first preferred embodiment.

Now the operation of the above-described third preferred embodiment will be described with reference to FIG. 9. In this figure, a solid line curve N represents a the output for a negative equi-pressure when a predetermined vacuum acts upon the vacuum chamber 80 to open the control valve 78. In the region on the right side of the solid line curve N, the vacuum generated in the port 6' is a high vacuum, and the high vacuum is introduced into the vacuum chamber 80 through the vacuum passage 76, so that the diaphragm 79 is sucked into chamber 80 against the resilient urging force of the spring 81 to operatively open the valve body 78' to open the valve 78, whereas in the region on the left side of the solid line curve N, the vacuum generated in the port 6' is a low vacuum, so that the valve body 78' is moved to close the valve 78 by the resilient urging force of the spring 81.

Accordingly, with reference to FIG. 9, in the operating region on the left side of the solid line curve L, the control valves 9, 24 and 78 are closed and thereby both the exhaust gas recirculation and the air intake are interrupted; in the region F on the right side of the solid line L, on the left side of the solid line curve N and on the left side of the straight solid line M, the control valves 9 and 10 are opened and thereby the exhaust gas recirculation is effected and controlled in correlation with the degrees of opening of the aforementioned respective valves; in the region G on the right side of the solid line curve N and on the left side of the straight solid line M, the control valves 9, 10 and 78 are opened and thereby the exhaust gas recirculation is effected and controlled in correlation with the degrees of opening of these three valves; and in the region H on the right sides of the solid lines N and M, the control valves 10 and 24 are opened while the other valves 9 and 78 are closed, so that the air intake is effected and controlled in correlation with the degrees of opening of the aforementioned control valves 10 and 24.

Here it is to be noted that while the diluting air intake passage 23 is connected via an air filter 22 to the atmosphere and thereby air is sucked into the exhaust gas recirculation passage 8 from the diluting intake passage 23 according to the above-described respective embodiments, if, as shown in FIG. 10, the path 23 is connected to the interior of the intake passage 2 between the throttle valve 3 and the Venturi tube in the carburetor 1, then a lean air-fuel mixture is drawn into the recirculation path and substantially similar effects and advantages to those described above can be achieved.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. An intake control apparatus for an internal combuation engine having an air-fuel passage and an exhaust passage and a carburetor with a throttle valve in the intake passage, said intake control apparatus comprising: an exhaust gas recirculation passage for connecting the exhaust passage of the internal combustion engine to the intake passage downstream of the carburetor for recirculating a part of the exhaust gas of the engine; at least two exhaust gas recirculation rate control valves in said exhaust gas recirculation passage in series with each other; a diluting intake passage connected to said exhaust gas recirculation passage between two control valves among said plurality of rate control valves for taking in an air containing diluting gas which at the most has no more fuel therein than sufficient to make the gas a lean mixture of air and fuel and at the least has no fuel therein; diluting gas supply means connected to said diluting gas intake passage; and an intake control valve in said diluting intake passage and adapted to be connected to said intake passage adjacent said throttle valve; intake control valve actuating means connected to said intake control valve and responsive to the pressure in said intake passage for actuating said intake contol valve for controlling the degree of opening of said diluting intake passage; and a control device adapted to be connected to the engine and responsive to an operating condition of the engine and connected to the particular exhaust gas recirculation rate control valve in said exhaust gas recirculation passage upstream of the position where said diluting intake passage opens into said exhaust gas recirculation passage for opening and closing said particular exhaust gas recirculation rate control valve, and said control device further being connected to said intake control valve for opening and closing said intake control valve, said control device being operative to control the opening and closing of the respective valves so that one of said valves is open and the other valve is closed and vice versa.

2. An intake control apparatus as claimed in claim 1 in which said particular exhaust gas recirculation rate control valve in said exhaust gas recirculation passage downstream of the position where said diluting intake passage opens into said exhaust gas recirculation passage is adapted to be connected to the carburetor for operation in correlation with the angle of opening of the throttle valve in the carburetor.

3. An intake control apparatus as claimed in claim 1 in which said exhaust gas recirculation rate control valve and said intake control valve which are opened and closed by said control device are both diaphragm type control valves each having a vacuum chamber adapted to be connected with a port in the intake passage somewhat upstream of the fully closed position of the throttle valve in the carburetor and further having a diaphragm and a valve body connected thereto for operatively opening and closing the valve body in response to the magnitude of the pneumatic pressure in said vacuum chamber, and said control device comprising atmospheric passages connected between the vacuum chambers of said two control valves and the atmosphere and means for selectively opening and closing said atmospheric passages for admitting atmospheric air into the respective vacuum chambers of said two control valves.

4. An intake control apparatus as claimed in claim 3 in which said control device is adapted to be connected to the engine for responding to the speed of the engine for connecting the exhaust gas recirculation rate control valve with the intake passage when the rotational speed is lower than a predetermined speed and connecting the intake control valve with the intake passage when the rotational speed is higher than a predetermined speed.

5. An intake control apparatus as claimed in claim 3 in which said control device is adapted to be connected to the intake passage of said engine for responding to the magnitude of the vacuum in said intake passage for selectively controlling the opening and closing of the atmospheric passage in accordance with the magnitude of the vacuum.

6. An intake control apparatus as claimed in claim 5 in which said control device is adapted to be connected to the intake passage of the engine somewhat upstream of the position at which the vacuum chamber of the exhaust gas recirculation rate control valve is connected to the intake passage.

7. An intake control apparatus as claimed in claim 6 in which said connection between said control device and said intake passage has an orifice therein.

8. An intake control apparatus as claimed in claim 6 in which said connection between said control device and said intake passage has an orifice and a check valve in parallel therein.

9. An intake control apparatus as claimed in claim 3 in which said particular exhaust gas recirculation rate control valve in said exhaust gas recirculation passage downstream of the position where said diluting intake passage opens into said exhaust gas recirculation passage is a diaphragm type control valve having a vacuum chamber adapted to be connected with the intake passage in the engine and further comprises a diaphragm and a valve body connected thereto for operatively opening and closing the valve body in response to the pneumatic pressure in said vacuum chamber.

10. An intake control apparatus as claimed in claim 3 further comprising an auxiliary control valve in said exhaust gas recirculation passage in parallel with said exhaust gas recirculation rate control valve that is connected to said control device, said auxiliary control valve being connected to said control device for being closed when said exhaust gas recirculation rate control valve is closed by said control device.

11. An intake control apparatus as claimed in claim 1 in which said diluting intake passage has the upstream end thereof open to the atmosphere.

12. An intake control apparatus as claimed in claim 1 in which said diluting intake passage has the upstream end adapted to be connected to the carburetor for receiving a lean air fuel mixture from the carburetor.

* * * * *